United States Patent [19]

Haneda

[11] Patent Number: 4,721,662

[45] Date of Patent: Jan. 26, 1988

[54] ELECTROPHOTOGRAPHIC IMAGE FORMING METHOD TO PRODUCE MULTICOLOR IMAGES

[75] Inventor: Satoshi Haneda, Hachioji, Japan

[73] Assignee: Konishiroku Photo Industry Co., Ltd., Tokyo, Japan

[21] Appl. No.: 923,396

[22] Filed: Oct. 23, 1986

[30] Foreign Application Priority Data

Nov. 5, 1985 [JP] Japan ..... 60-248593

[51] Int. Cl.[4] ..... G03G 13/01

[52] U.S. Cl. ..... 430/42; 430/55

[58] Field of Search ..... 430/43, 44, 55, 42

[56] References Cited

U.S. PATENT DOCUMENTS 4,230,783 10/1980 Aoki et al. ..... 430/42

*Primary Examiner*—J. David Welsh

*Attorney, Agent, or Firm*—Frishauf, Holtz, Goodman & Woodward

[57] ABSTRACT

An image forming method of repeating a whole-surface exposure of a specified light and a development for a photosensitive member having a color separating function. The quantity of light of the whole-surface exposure L is expressed by the following formula for a light quantity $L_0$ indicating that the potential generated by the whole-surface exposure is saturated:

$$0.7L_0 \leqq L \leqq 5L_0.$$

16 Claims, 28 Drawing Figures

ELECTROPHOTOGRAPHIC IMAGE FORMING METHOD TO PRODUCE MULTICOLOR IMAGES

BACKGROUND OF THE INVENTION

1. Field of the Invention

The present invention relates to an image forming method for forming an image on a photosensitive member and, more particularly, to an image forming method for forming a multicolor image on a multicolor image forming photosensitive member to be used for electrophotography.

2. Description of the Prior Art

For forming a multicolor image by the electrophotography, there have been proposed in the prior art a number of methods and apparatus therefor, which can generally be classified into the following categories. One method repeats the formation of a latent image using a photosensitive member in accordance with the number of colors to be separated and the development using a color toner to superpose the colors on the photosensitive member, or transfers the color to a transfer material upon each development thereby to superpose the colors on the transfer material. Another method uses an apparatus, which has a plurality of photosensitive members according to the number of colors to be separated, to expose optical images in individual colors simultaneously on the respective photosensitive members, to develop latent images formed on the respective photosensitive members with color toners, and to transfer the developed images sequentially to a transfer material thereby to form a multicolor image having superposed colors.

However, the aforementioned first method has to repeat the latent image formation and the development several times and is defective in that it requires a long time for recording the image and is difficult to speed up. On the other hand, the aforementioned second method uses a plurality of photosensitive members in parallel and is advantageous in high speed. However, the second method requires a plurality of photosensitive members, optical members, optical systems and developing means and has its apparatus complicated, large-sized and highly costing so that it is short of practicability. Moreover, both of the two methods have found it difficult to register the images, when the image formations and transfers are repeated several times, and are seriously defective in that they cannot completely prevent the color drifts of the image.

In order to solve such problems, I have previously proposed methods of recording a multicolor image on a single photosensitive member by a single image exposure. One of the methods will be described in the following.

Specifically, this method uses a photosensitive member which is prepared by arranging a photosensitive layer, which is photosensitive over the entire visible range, with an insulating layer which has a plurality of color separating filters (i.e., filters which have their individual filter portions substantially transmissive only to rays of predetermined wavelength ranges) combined in fine linear or mosaic shapes. First of all, the photosensitive member thus prepared has its whole surface exposed to an image to distribute charges according to separate image densities in a photoconductive layers underlying the respective filters (to form a primary latent image, as will be so called in the following). Then, a whole-surface exposure is conducted with light capable of being transmitted through a first color separating filter to develop only the photoconductive layer underlying said filter with a color toner in a color corresponding to the kind of the filter formed with an electrostatic latent image (which will be called a "secondary latent image") according to the intensity of the primary latent image formation, preferably, in a color complementary to the color capable of transmitting through the filter, followed by a uniform charging treatment. Then, for the individual color separate images, similar whole-surface exposures, developments and recharging treatments are repeated to form the multicolor image on the photosensitive member so that the multicolor image is recorded all at once on the transfer material by a single transferring treatment.

As to the filter, however, the method described above has practical difficulties in the preparation of a filter which ideally has transmissivity only in a specified wavelength range. In order to prevent the sensitivity of the photosensitive member from dropping, however, the spectroscopic transmissivity of the filter is desired to be as high as possible. In practice, a filter would its spectral transmissivity enhanced also has increased its transmissivity to other wavelengths.

On the other hand, the aforementioned method releases the charges from the photosensitive layer corresponding to a specified filter by exposing the whole-surface of the photosensitive member to specified light. As to the exposing light, however, the whole-surface exposing light generally has a wavelength distribution, and each filter has a little transmissivity to wavelengths other than its specified one. As a result, the whole-surface exposing light will release considerable charges from other filter portions. This means that potential patterns are formed in those other filter portions. Although sufficient exposure may be applied for the image formations in the NP and KIP methods using photosensitive members having transparent insulating layers according to the prior art, the present method cannot apply specified whole-surface exposure infinitely.

SUMMARY OF THE INVENTION

An object of the present invention is to provide an image forming method which is enabled to conduct satisfactory color reproduction of a multicolor image without any color mixing by a high-speed and simple process. The image should further be formed using a photosensitive member capable of recording a multicolor image at a high speed and simply without any color drift by a single image exposure.

In the present invention, the quantity of light for the whole-surface exposure is set under a condition that a sufficient potential contrast is established for a specified color separating portion but not for other color separating portions.

According to a feature of the present invention, there is provided an image forming method for repeating a whole-surface exposure of a specified light and a development for a photosensitive member having a color separating function after a charging treatment and an image exposure for the same, which method is characterized in that the quantity of light of said whole-surface exposure is expressed by the following formula for a light quantity $L_0$ indicating that the potential generated by said whole-surface exposure L is substantially saturated:

$0.7L_O \leqq L \leqq 5L_O$.

According to a more preferable feature of the present invention, there is provided an image forming method characterized in that the light quantity of said whole-surface exposure L is expressed by the following formula:

$0.9L_O \leqq L \leqq 3L_O$.

Moreover, the image forming method of the present invention is characterized: by having a layer composed of a plurality of color separating portions mainly transmissive to rays of different wavelength ranges; and by having the step of subjecting said photosensitive member to an image exposure, and by subsequently repeating, in the order of the kinds of said color separating portions, the operations of subjecting at least one kind of said color separating portions to a whole-surface exposure to form a potential pattern and developing the same.

Other objects and features of the present invention will become apparent from the following description taken with reference to the accompanying drawings.

BRIEF DESCRIPTION OF THE DRAWINGS

Some examples of embodiments of the present invention are shown in the following drawings, in which.

DESCRIPTION OF THE PREFERRED EMBODIMENTS

The present invention will be described in detail in the following in connection with its embodiment, in which it is applied to a multicolor image forming photosensitive member (which will be shortly referred to as a "photosensitive member") and a multicolor image forming process. The following description is directed to a full-color reproducing photosensitive member which uses as its color separating filters individual red, green and blue filters made transmissive only to red, green and blue rays, respectively. Despite this fact, however, the colors of the separate filters and the colors of toners to be combined with the former should not be limited to the above-specified ones.

FIG. 1 shows the shapes and arrangements of filters according to the present invention, for example. Here, letters B, G and R denote blue, green and red filter portions, respectively.

Figure 1A:
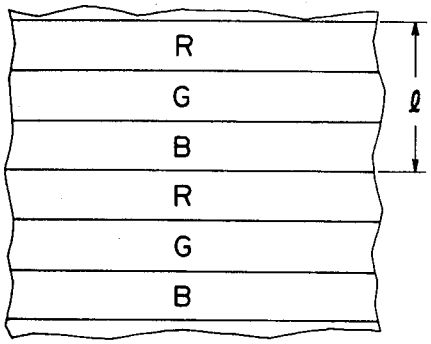
FIGS. 1(A), 1(B) and 1(C) are top plan views showing the arrangements of filters on the surfaces of individual photosensitive members.

FIG. 1(A) shows a linear shape, which is exemplified by lines arranged orthogonally or parallel in the direction of rotation in case the photosensitive member has a shape of drum.

Figure 1B:
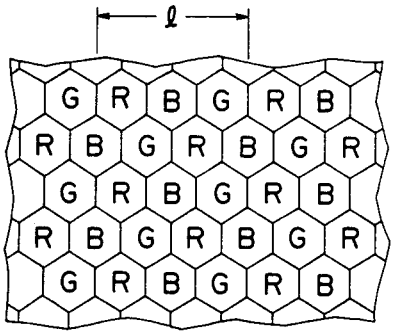
Figure 1C:
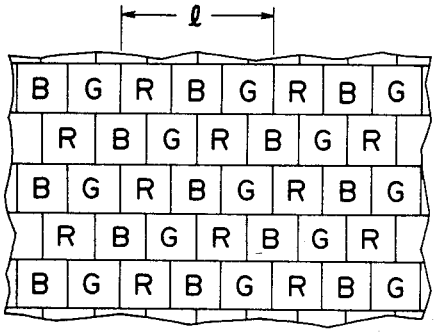

FIGS. 1(B) and 1(C) show mosaic shapes, in which the individual filter portions are desirably sized such that the length denoted at l in FIG. 1 be 10 to 500 μm. In case the size of the filter portions is excessively small, the filter portions are liable to be influenced by their adjacent portions of different colors. On the other hand, the filter portions become difficult to prepare if the width of each of them is equal to or smaller than the diameter of toner particles. If the filter portions are oversized, on the contrary, resolutions and color-mixings of the images drop to deteriorate the image quality. The shape and arrangement should not be limited to those shown in FIG. 1 but may be arbitrary.

FIG. 2 schematically shows the sections of photosensitive members which can be used in the present invention. On a conductive member or a substrate 1, there is formed a photoconductive layer 2, on which is laminated an insulating layer 3 including a number of desired color separating filters such as red (R), green (G) and blue (B) filter portions.

The conductive substrate 1 may be formed of either a metal such as aluminum, iron, nickel or copper or their alloy into suitable shape and construction such as a shape of cylinder or endless belt.

The photoconductive layer 2 is similarly formed by vapor deposition or resin dispersion and subsequent application of: a photoconductive substance made of sulfur, selenium, amorphous silicon, or an alloy containing sulfur, selenium, tellurium, arsenic or antimony; an inorganic photoconductive substance made of an oxide, iodide, sulfide or selenide of a metal such as zinc, aluminum, antimony, bismuth, cadmium or molybdenum; or an organic photoconductive substance such as vinylcarbazole, anthracenephthalocyanine, trinitrofluorenone, polyvinylcarbazole, polyvinylanthracene, polyvinylpyrene, polycyclic quinone dye or bisazo dye. This binder resin is enumerated by an insulating resin such as polyethylene, polyester, polypropyrene, polystyrene, polyvinylchloride, polyvinylacetate, polycarbonate, acrylic resin, silicon resin, fluorine-contained resin or epoxy resin. Moreover, there can also be used a function-separated type photoconductive layer which is composed of a charge generating layer and a charge transfer layer.

Figure 2A:
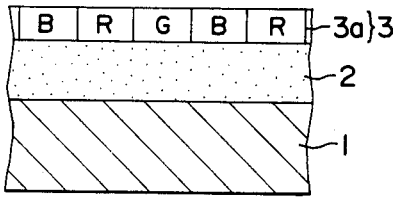
FIGS. 2(A), 2(B), 2(C) and 2(D) are sectional views showing the photosensitive members.
Figure 2B:
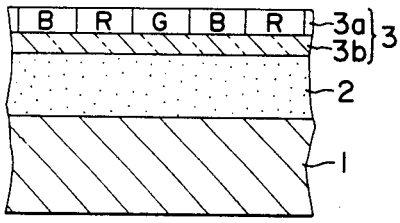
Figure 2C:
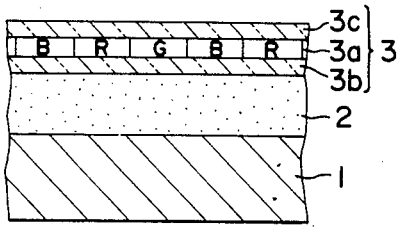
Figure 2D:
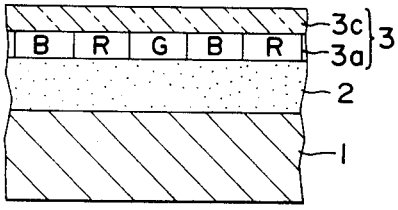
Figure 3A:
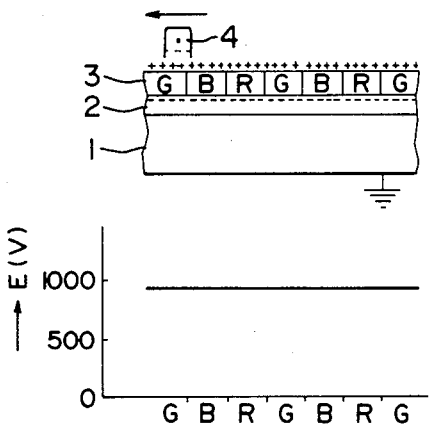
FIGS. 3(A), 3(B), 3(C), 3(D), 3(E), 3(F), 3(G) and 3(H) are process flow charts showing image forming steps.
Figure 3B:
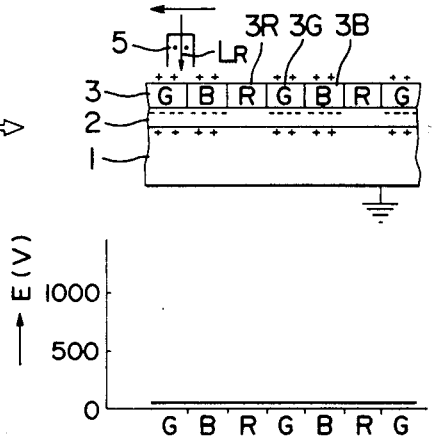
Figure 3D:
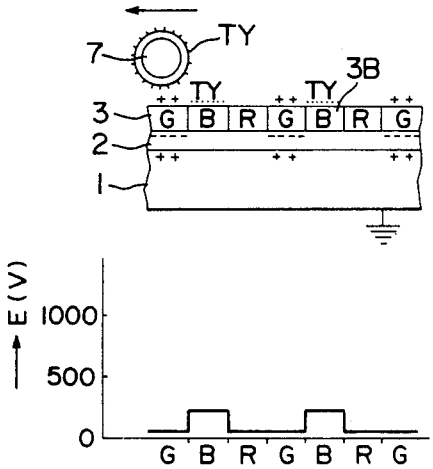
Figure 3C:
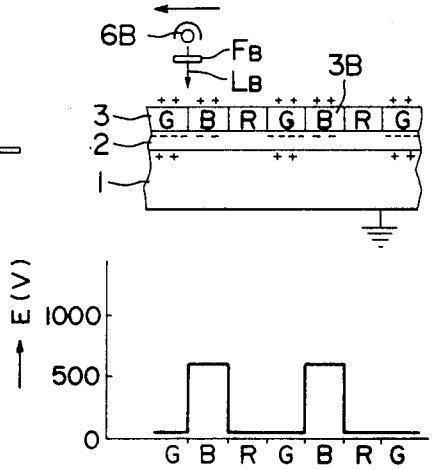
Figure 3E:
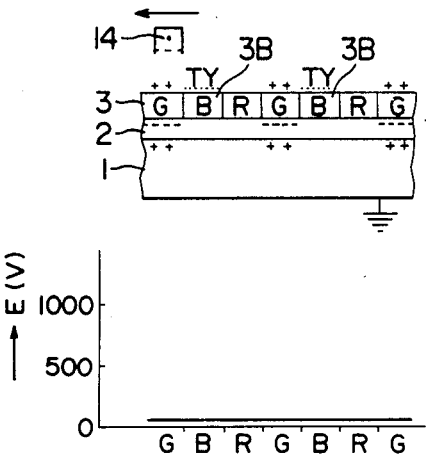
Figure 3F:
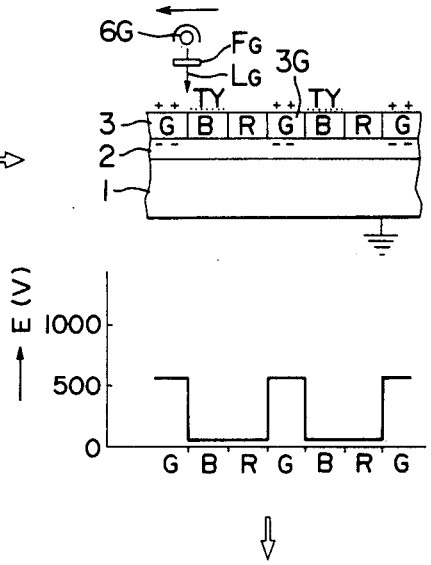
Figure 3H:
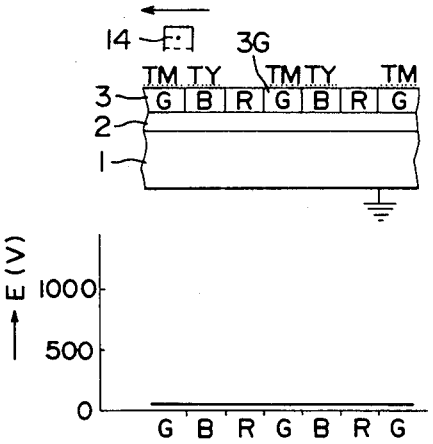
Figure 3G:
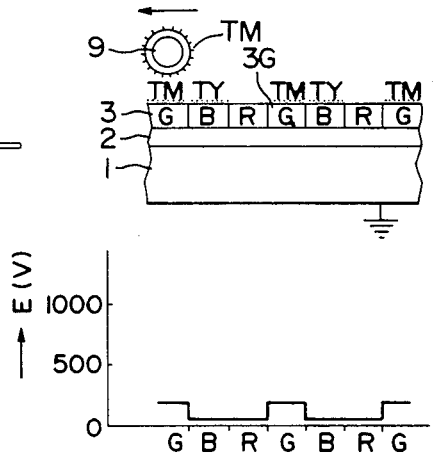

The insulating layer 3 can be made of a transparent insulating substance such as a variety of polymers or resins and is formed thereon or therein with a colored portion acting as a color separating filter. This colored portion is prepared, as shown in FIG. 2(A), by adhering an insulating substance, which is colored by adding a coloring agent such as a dye or pigment having a desired color, in a predetermined pattern on the photoconductive layer 2 by printing means or the like. In this case, paints of individual colors are printed several (e.g., three) times in a superposed manner. Alternatively, as shown in FIG. 2(B), coloring agents can be adhered in a predetermined pattern on a colorless insulating layer 3*b*, which is uniformly formed in advance on the photoconductive layer 2, by printing, photo resist or vapor deposition means. Moreover, the photosensitive member having the constructions of FIGS. 2(A) and 2(B) can be constructed even if a film-shaped insulating substance formed in advance with colored portions is applied to the photoconductive layer. Still moreover, the colored portions thus formed may have their surfaces further covered with an insulating substance 3*c* to provide structures shown in FIGS. 2(C) and 2(D).

Incidentally, FIGS. 1(A) to 1(C) and FIGS. 2(A) to 2(D) show the cases in which the so-called "trichromatic filters" of red, green and blue colors are used.

Next, the process of forming the multicolor image using the aforementioned photosensitive member will be described with reference to FIG. 3. FIG. 3 schematically shows the image forming process by taking out a portion of the photosensitive member which uses an n-type (i.e., high electron-mobility type) photo-semiconductor such as cadmium sulfide as the photoconductive layer. In FIG. 3, reference numerals 1 and 2 denote a conductive substrate and a photoconductive layer, respectively, and numeral 3 denotes an insulating layer including trichromatic filter portions R, G and B. On the other hand, the graphs located below the respective Figures show the potentials at the surfaces of the respective portions of the photosensitive member.

First of all, as shown in FIG. 3[A], if a positive corona discharge is applied to the whole surface by a charging device 4, positive charges are generated on the surface of the insulating layer 3, and negative charges are accordingly induced on the boundary surface between the photoconductive layer 2 and the insulating layer 3.

Next, as shown in FIG. 3[B], a.c. or negative discharge is applied by a charging device 5 with an exposing slit, and exposing light of a colored image such as red image exposing light $L_R$ is applied while eliminating the charges on the surface of the insulating layer 3. The red light is transmitted through the red filter portion R of the insulating layer 3 to eliminate the charges in the photoconductive layer 2 at the same filter portion so as to render the underlying photoconductive layer 2 conductive. Since the green filter portion 3G and the blue filter portion 3B are not transmissive to the red light, on the contrary, the negative charges of the photoconductive layer 2 are left as they are. By the action of the charging device 5, moreover, the charge distribution on the insulating layer 3 is so varied that the surface potential of the photoconductive member may be made uniform.

Thus, a primary latent image is formed. The portions of an original, which have been irradiated with the green component and the blue component, also give similar results for the respective filter portions. In the primary latent image, all the color components are present in an image-shaped charge distribution below the respective filter portions. At this stage, neither the portion over the photoconductive layer 2 having its charges eliminated nor the portion having its charges left functions as an electrostatic image because they are at the same potential on the surface of the photosensitive member.

Incidentally, FIG. 3[B] shows the case in which the potential after the charge is substantially at zero, but this potential may be charged to a negative level.

Next, as shown in FIG. 3[C], a whole-surface exposure is conducted with a light transmissive to one kind of the filters contained in the insulating layer 3, for example, a blue light $L_B$ which is prepared by a light source 6B and a blue filter $F_B$. Then, the photoconductive layer 2 below the filter portion B transmissive to the blue light is rendered conductive to neutralize a part of the negative charges in the photoconductive layer 2 at said portion and the charges held by the conductive substrate 1 to leave only the charges on the surfaces of the filters B so that a potential pattern is formed. No charge occurs in the portions of the filters G and R not transmissive to the blue light. Thus, a secondary latent image is formed. If the charge image on the filters B is developed with a developer containing a Yellow toner TY charged negative, this toner sticks only to the surfaces of the filter portions B having a relatively high potential, thus effecting the development (as shown in FIG. 3[D]).

Next, in order to eliminate the potential difference caused, the surface potential is made uniform by a charging device 14, as shown in FIG. 3[E]. After this, a whole-surface exposure is applied with a green light $L_G$, as shown in FIG. 3[F]. Then, a secondary latent image is formed on the portions of the green filters G as in the aforementioned case of the blue light. If this secondary latent image is developed with a Magenta toner TM, as shown in FIG. 3[G], this Magenta toner TM sticks only to the portions of the filters G. Subsequently, as shown in FIG. 3[H], the surface potential is similarly made uniform. After this, a whole-surface exposure is applied with red light, and the resultant secondary latent image appearing on the red filter portions R is developed with a Cyan toner TC. Incidentally, in the shown example, no potential difference is generated in the red filters R even by the whole-surface exposure because no charge is present in the photoconductive layer 2. As a result, the Cyan toner does not adhere even after the development using it.

The toner images thus obtained are transferred to and fixed on a transfer material such as copy paper. Then, there is reproduced on the transfer material a red image of mixed colors of the Yellow toner and the Magenta toner. Incidentally, the image exposure is desirably conducted with the light which has its ultraviolet and infrared ranges cut off. For other colors, as tabulated in the following Table-1, the color reproductions are conducted by combining the trichromatic method and the three primary toners.

In this Table: symbols of "broken circles" indicate the state of the primary latent image forming step; symbols of "circles" indicate the secondary latent image forming step; symbols of "solid circles" indicate the state in which the development has been conducted; and symbols of "downward arrows" indicate that the states of upper columns are held as they are. Blanks indicate the state in which no image is present in the photoconductive layer.

TABLE 1

| | Originals | | | | | | | | | | | | | | | | | | | | | | | |
|---|---|---|---|---|---|---|---|---|---|---|---|---|---|---|---|---|---|---|---|---|---|---|---|---|
| | White | | | Red | | | Green | | | Blue | | | Yellow | | | Magenta | | | Cyan | | | Black | | |
| | Filters* | | | | | | | | | | | | | | | | | | | | | | | |
| | R | G | B | R | G | B | R | G | B | R | G | B | R | G | B | R | G | B | R | G | B | R | G | B |
| Image Exposure | | | | | ◻ | ◻ | ◻ | | ◻ | ◻ | ◻ | | | | ◻ | | ◻ | | ◻ | | | ◻ | ◻ | ◻ |
| Blue Whole-Surface Exposure | | | | | ↓ | ○ | ↓ | | ○ | ↓ | ↓ | | | | ○ | | ↓ | | ↓ | | | ↓ | ↓ | ○ |
| Yellow Development | | | | | ↓ | ⊘ | ↓ | | ⊘ | ↓ | ↓ | | | | ⊘ | | ↓ | | ↓ | | | ↓ | ↓ | ⊘ |
| Green Whole-Surface Exposure | | | | | ○ | | ↓ | | | ↓ | ○ | | | | | | ○ | | ↓ | | | | ○ | |
| Magenta Development | | | | | ⊘ | | | | | | ⊘ | | | | | | ⊘ | | | | | | ⊘ | |
| Red Whole-Surface Exposure | | | | | | | ↓ | | | ↓ | | | | | | | | | ↓ | | | ↓ | | |
| Cyan Development | | | | | | | ○ | | | ○ | | | | | | | | | ○ | | | ○ | | |
| Toner Having Sticked** | — | — | — | — | M | Y | C | — | Y | C | M | — | — | — | Y | — | M | — | C | — | — | C | M | Y |
| Reproduction | White | | | Red | | | Green | | | Blue | | | Yellow | | | Magenta | | | Cyan | | | Black | | |

wherein:
*solid single star: filters on photosensitive members; and
**solid double star: presence of respective toners of Y: Yellow, M: Magenta; and C: Cyan.

Incidentally, the description thus far made is directed to the example using the n-type photo-semiconductor layer, but it is naturally possible to use a p-type (i.e., high hole mobility type) photo-semiconductor layer such as selenium. In this case, all the fundamental processes are identical except that the plus and minus signs of the charges are wholly reversed. Incidentally, in case the charges are difficult to inject for the primary charging operation, a uniform irradiation of light is used together.

As is now apparent from the description thus far made, according to the present embodiment, after the multicolor image forming photosensitive member is subjected, while being charged, to the image exposure, the developing step of the whole-surface exposure with the light capable being transmitted through one of the several filters is repeated in accordance with the kinds of the filters. More specifically, the fine color separating filters are arranged on the photosensitive member. After the image exposure (i.e., the step of FIG. 3[B]), the whole-surface exposure using the trichromatic light is applied (i.e., the steps of FIGS. 3[C] and 3[F]) to form the secondary latent images on the individual color portions of the color separating filters, and these secondary latent images are developed with the toners of corresponding colors (i.e., the steps of FIGS. 3[D]and 3[G]). These steps are repeated to form the multicolor image. Thus, this process uses the photosensitive member in which the plural color separating filters are arranged in the fine linear or mosaic shape in combination with the photoconductive layer having optical sensitivity to the whole visible range. First, the photosensitive member has its whole surface exposed to latent image light to form the primary latent image according to the density of the separated image on the photosensitive layers underlying the individual filters. Next, the photosensitive member has its whole surface exposed to the light to be transmitted through the first color separating filter to form the secondary latent image corresponding to the primary latent image on said filter portion. This secondary latent image is developed with the color toner of the color corresponding to that of the filter, preferably, the color complementary to the color to be transmitted through the filter. Then, similar operations are repeated for the respective color separated images to form the multicolor image on the photosensitive member. This multicolor image can be recorded all at once on the transfer material by the single transfer.

Figure 4:
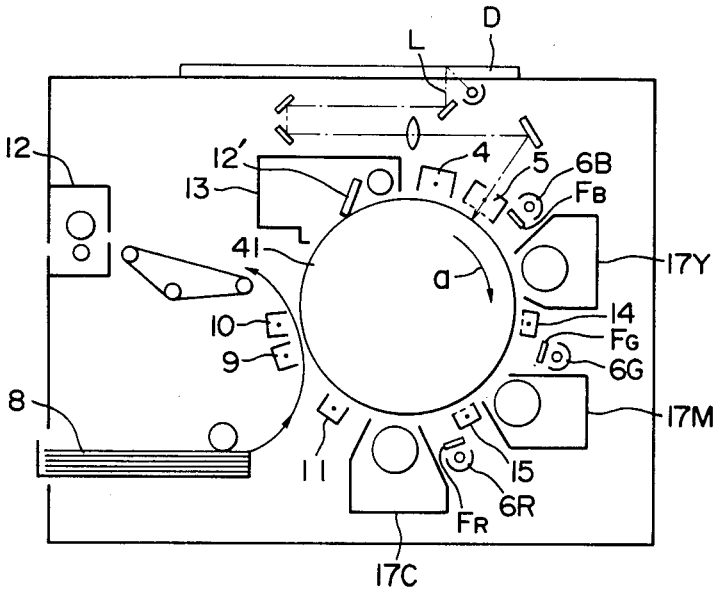
FIG. 4 is a schematic view showing a color reproducing machine.

FIG. 4 is a schematic view showing an image forming apparatus of a color copying machine according to the embodiment of the present invention suitable for executing the process described above. In FIG. 4, reference numeral 41 denotes a photosensitive drum which has the construction shown in FIGS. 1 and 2 and which is made rotatable in the direction of arrow a during the copying operation. The photosensitive drum 41 is rotated and has its whole surface charged by the charging electrode 4, while being irradiated with light, if necessary. The photosensitive drum 41 is exposed to image exposing light L of an original document D, while being subjected to a corona discharge of alternating current or of the polarity opposed to that of the electrode 4 by means of the downstream electrode 5 having the exposing slit, thus ending the step of forming the primary latent image. Next, the whole surface is exposed to the blue light, which is obtained by combining the light source 6B and the light source blue filter $F_B$, to form the secondary latent image of the Yellow component. This secondary latent image is then developed by a developing device 17Y which is charged with the Yellow toner. Subsequently, the photosensitive drum has its surface charged to have a uniform potential by an electrode 14. After this, the photosensitive drum is subjected to a whole-surface exposure with green light coming from a light source 6G through a light source green filter $F_G$ and is developed by a developing device 17M which is charged with the Magenta toner. The photosensitive drum is then subjected to a whole-surface exposure with red light coming from a light source 6R through a light source red filter $F_R$ and is developed by a developing device 17C which is charged with the Cyan toner. As a result, the multicolor image is formed on the photosensitive drum. The multicolor toner image thus obtained is charged by a pretransfer charging electrode 11 and is then transferred to the copy paper 8, which is fed by paper feed means, by a transfer electrode 9. The copy paper retaining the multicolor toner image transferred is separated from the photosensitive drum by a separating electrode 10 and is fixed by a fixing device 12 to complete a multicolor copy until it is discharged to the outside of the machine. The photosensitive drum 41 having finished the transfer is irradiated with a charge eliminating light and has its charges eliminated by a charge eliminating electrode and cleared from its surface by a cleaning blade 13 so that it may be used again.

The developer to be used in the image forming process described above can be exemplified by either the so-called "one-component developer" using a non-magnetic or magnetic toner or the so-called "two-component developer" which is prepared by mixing the toner and a magnetic carrier such as iron powder. For the development, a directly rubbing method using a magnetic brush may be employed. For at least second and later developments, however, a non-contact developing method of keeping the developer layer on the developer carrier out of rubbing contact with the surface of the photosensitive member is indispensable so as to prevent the toner image formed from being damaged. This non-contact method effects the development without any rubbing contact between the electrostatic image retainer (i.e., the photosensitive member) and the developer layer by using the one- or two-component developer containing the non-magnetic or magnetic toner having a freely selectable color and by generating an alternating electric field in the developing zone, as will be described in detail in the following.

In the repetition development using the aforementioned alternating electric field, the photosensitive member already having the toner images can be repeatedly developed. Unless a proper developing condition is not set, however, the toner image having been formed on the photosensitive member at the preceding step is disturbed, or the toner having already sticked to the photosensitive member is returned to the developer carrier to seal into the developing device at the subsequent step, which is charged with the developer in a color different from that of the developer of the preceding step, to raise a problem that the color mixing occurs. In order to prevent this problem, basically, the operations have to be conducted while keeping the developer layer on the developer carrier away from rubbing or contacting with the photosensitive member.

In other words, the gap between the photosensitive member and the developer carrier is held at a value larger than the thickness of the developer layer on the developer carrier (in case no potential difference is present between the two).

In order to completely avoid the aforementioned problem thereby to form each toner image in a sufficient image density, there exists a desirable developing condition, as has been revealed by our experiments.

This condition has clarified that the gap d (mm) between the photosensitive member and the developer carrier in the developing zone (which gap may be simply referred to as the "gap d"), and the amplitude $V_{AC}$ and the frequency f (Hz) of the a.c. component of a developing bias for generating the alternating electric field are difficult to determine independently of one another and that these parameters are closely correlated to one another, as will be described in the following.

The experiments were conducted by using the color copying machine shown in FIG. 4 to examine the influences of the parameters such as the voltage and frequency of the a.c. component of the developing bias of the developing device 17M when a two-color toner image was to be formed by the developing devices 17Y and 17M.

Figure 5:
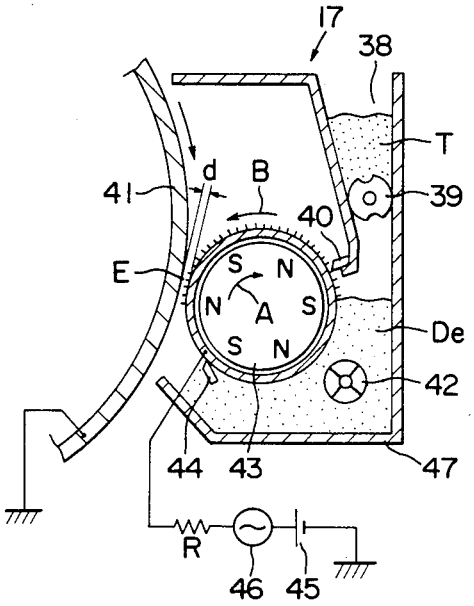
FIG. 5 is a sectional view showing a developing device.

FIG. 5 shows the basic construction of each of the developing devices 17Y, 17M and 17C shown in FIG. 4. When a sleeve 7 and/or a magnetic roll 43 are rotated, a developer De is carried in the direction of arrow B on the circumference of the sleeve 7 so that it is fed to the developing zone E. When the magnetic roll 43 is rotated in the direction of arrow A whereas the sleeve 7 is rotated in the direction of the arrow B, the developer De is carried in the direction of the arrow B. The developer De has its thickness regulated in its carrying course by an ear regulating blade 40 of magnetic materials. A developer reservoir 47 is equipped therein with a agitating screw 42 for sufficiently agitating the developer De. When the toner in the developer reservoir 47 is consumed, toner T is supplied from a toner hopper 38 by rotating a toner supply roller 39.

Between the sleeve 7 and the photosensitive drum 41, moreover, there are connected in series a d.c. power source 45 and an a.c. power source 46 for applying a developing bias.

The developer De supplied at first to the developing device 17M is a one-component magnetic developer which is prepared by kneading and pulverizing 70 wt % of a thermoplastic resin, 10 wt % of a pigment (e.g., carbon black), 20 wt % of a magnetic material and a charge controlling agent to have an average particle diameter of 15 μm and by adding thereto a fluidizer such as silica. The charging degree is controlled by a charge controlling agent.

Figure 6:
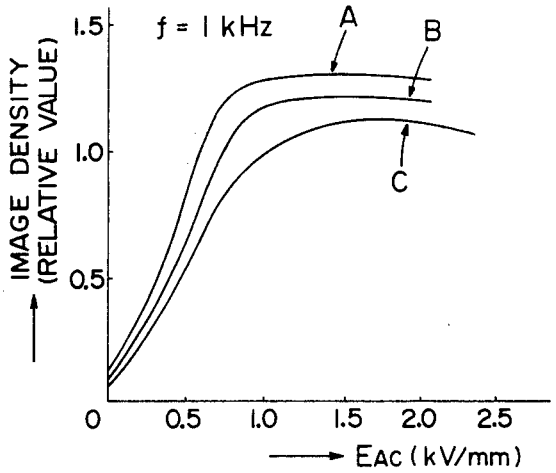
FIGS. 6 and 7 are graphs showing experimental data of developments using a one-component developer.
Figure 7:
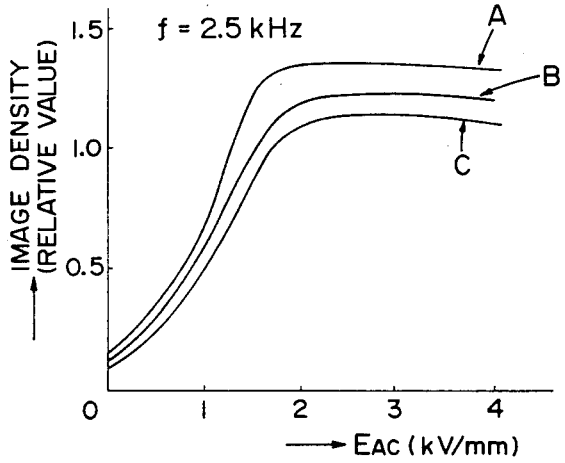

The experiments produced the results shown in FIGS. 6 and 7.

FIG. 6 shows the relationship between the amplitude of the a.c. component of a developing bias to be applied to the sleeve 7 and the density of the black toner image when a zone of the photosensitive member having a surface potential of 500 V was developed by the developing device 17M after a uniform exposure subsequent to a charging treatment under the conditions: that the gap d between the photosensitive drum 41 and the sleeve 7 was 0.7 mm; that the developer layer had a thickness of 0.3 mm; that the d.c. component of the developing bias had a voltage of 50 V; and that the a.c. component of the developing bias had a frequency of 1 kHz. Incidentally, the developing device 17Y at this time is stored with a two-component developer composed of a Yellow toner and a carrier. The amplitude $E_{AC}$ of the intensity of the a.c. electric field is obtained by dividing the amplitude $V_{AC}$ of the a.c. voltage of the developing bias by the gap d. Curves A, B and C appearing in FIG. 6 plot the results of the cases, in which the average charges of the magnetic toner used were −5 μc/g, −3 μc/g and −2 μc/g, respectively. From all the three curves A, B and C, it has been observed that the image density was high for the amplitude of the a.c. component at 200 V/mm or more and 1.5 kV/mm or less, and that the toner image formed in advance on the photosensitive drum 41 was partially broken for the amplitude of 1.6 kV/mm or more.

FIG. 7 shows the changes in the image density when the intensity of the a.c. electric field was changed for the a.c. component of the developing bias having a frequency of 2.5 kHz and under the same conditions as those of the experiments shown in FIG. 6.

According to these experimental results, the image density was high for the amplitude $E_{AC}$ of the aforementioned a.c. electric field intensity of 500 V/mm or more and 3.8 kV/mm or less, and the toner image formed in advance on the photosensitive drum 41 was partially broken for the amplitude of 3.2 kV/mm or more (although not shown in FIG. 6).

Incidentally, as can be understood from the results of FIGS. 6 and 7, the image density changes to saturate or drop at a certain amplitude value, which is not so dependent upon the average charge of the toner, as is seen from the curves A, B and C.

Figure 8:
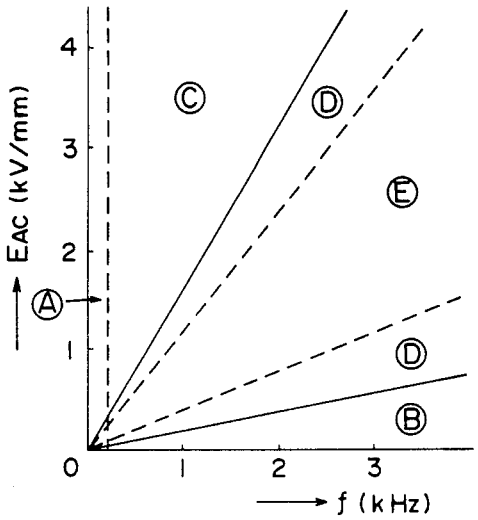
FIG. 8 is a graph showing the optimum condition of the developments using the one-component developer.

Here, experiments similar to those of FIGS. 6 and 7 were conducted under different conditions to reveal that the relationship between the amplitude $E_{AC}$ and the frequency of the a.c. electric field intensity can be rearranged to provide the results shown in FIG. 8.

In FIG. 8: development irregularities are liable to occur in a zone indicated at Ⓐ; the effect of the a.c. component will not appear in a zone indicated at Ⓑ; the toner image formed in advance is liable to break in a zone indicated at Ⓒ; and the effect of the a c. component appears to provide a sufficient development density, and the toner image formed in advance is not broken in zones indicated at Ⓓ and Ⓔ, of which the zone Ⓔ especially preferable.

These results indicate that a proper zone is present with respect to the amplitude and frequency of the a.c. electric field intensity so as to prevent the toner image formed in advance (i.e., at a preceding step) on the photosensitive drum 41 from being broken and to develop a subsequent (i.e., at a subsequent step) toner image in a proper density.

On the basis of the experimental results thus far described, I have concluded that the subsequent development can be conducted in the proper density without disturbing the toner image formed in advance on the photosensitive member 41, if each developing step satisfies the following condition:

$$0.2 \leqq V_{AC}/(d \cdot f) \leqq 1.6,$$

wherein: the amplitude and frequency of the a.c. component of the developing bias is designated by $V_{AC}$ (V) and f (Hz), respectively; and the gap between the photosensitive drum 41 and the sleeve 7 is designated by d (mm). In order to obtain a sufficient image density and to leave undisturbed the toner image formed by the preceding step, it is more desirable to satisfy the following condition of the zone in which the image density has a tendency to increase with respect to the a.c. electric field in FIGS. 6 and 7:

$$0.4 \leqq V_{AC}/(d \cdot f) \leqq 1.2.$$

It is more desirable to satisfy that following zone of the above-specified zone, in which the image density is in an electric field rather lower than the saturation level:

$$0.6 \leqq V_{AC}/(d \cdot f) \leqq 1.0.$$

It is more desirable to set the frequency f of the a.c. component at 200 Hz or more so as to prevent the development irregularities due to the a.c. component, and to set the frequency of the a.c. component at 500 Hz or more so as to eliminate the influences from the beats caused by the a.c. component and the rotations of the magnetic roll, in case a rotating magnetic roll is used as means for supplying the developer to the photosensitive drum 41.

Next, by using a two-component developer, similar experiments were conducted by the color copying machine shown in FIG. 4. The developer De stored in the developing device 17M is the two-component developer composed of a magnetic carrier and a non-magnetic toner. Said carrier is prepared by dispersing fine iron oxide having an average particle diameter of 20 μm, a magnetization of 30 emu/g and a resistivity of $10^{14}$ Ω-cm into a resin. Incidentally, the resistivity is a value which is obtained by confining and tapping the particles in a container having a sectional area of 0.50 $cm^2$, by applying a load of 1 $kg/cm^2$ to the packed particles, by applying such a voltage between the load and the bottom electrode as is generated by an electric field of 1,000 V/cm, and by reading the resultant current value. Said toner used is prepared by adding a small quantity of charge controlling agent to 90 wt % of thermoplastic resin and 10 wt % of pigment (e.g., carbon black), and by kneeding and pulverizing them to have an average particle diameter of 10 μm. Said carrier and said toner were mixed at a ratio of 80 wt % to 20 wt % to prepare the developer De. Incidentally, the toner is charged to a negative polarity by the friction with the carrier.

Figure 9:
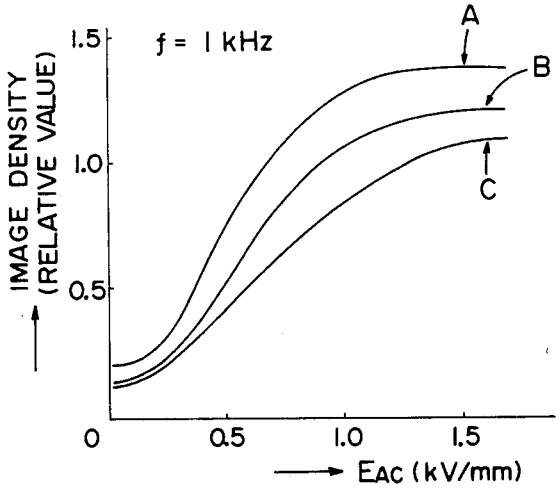
FIGS. 9 and 10 are graphs showing the experimental data of developments using a two-component developer.
Figure 10:
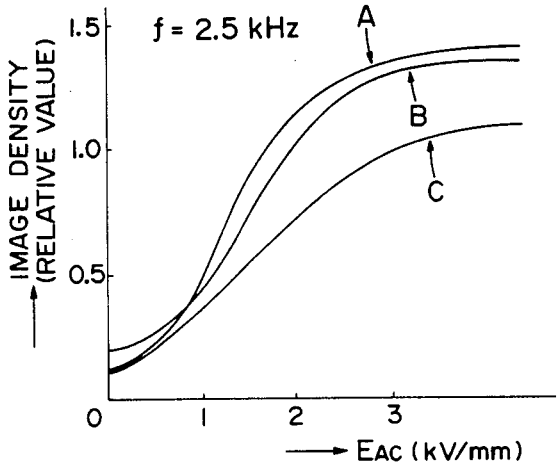

These experimental results are shown in FIGS. 9 and 10.

FIG. 9 shows the relationship between the amplitude of the a.c. component of a developing bias and the density of the black toner image when a zone of the photosensitive member having a surface potential of 500 V was developed after a uniform exposure subsequent to a charging treatment under the conditions: that the gap d between the photosensitive drum 41 and the sleeve 7 was 1.0 mm; that the developer layer had a thickness of 0.7 mm; that the d.c. component of the developing bias had a voltage of 50 V; and that the a.c. component of the developing bias had a frequency of 1 kHz. Incidentally, the developing device 17Y is stored with a two-component developer composed of a Yellow toner and a carrier. The amplitude $E_{AC}$ of the intensity of the a.c. electric field is obtained by dividing the amplitude $V_{AC}$ of the a.c. voltage of the developing bias by the gap d.

Curves A, B and C appearing in FIG. 9 plot the results of the cases, in which the average charges of the toner used were controlled to −30 μc/g, −20 μc/g and −15 μc/g, respectively. From all the three curves A, B and C, it has been observed that the effect of the a.c. component appeared for amplitude of the a.c. component at 200 V/mm or more, and that the toner image formed in advance on the photosensitive drum 41 was partially broken for the amplitude of 2,500 V/mm or more.

FIG. 10 shows the changes in the image density when the intensity $E_{AC}$ of the a.c. electric field was changed for the a.c. component of the developing bias having a frequency of 2.5 kHz and under the same conditions as those of the experiments of FIG. 9.

According to these experimental results, the image density was high for the amplitude $E_{AC}$ of the aforementioned a.c. electric field intensity of 500 V/mm or more, and the toner image formed in advance on the photosensitive drum 41 was partially broken for the amplitude of 4 kV/mm or more (although not shown in the drawings).

Incidentally, as can be understood from the results of FIGS. 9 and 10, the image density changes to saturate or drop at a certain amplitude value, which is not so dependent upon the average charge of the toner, as is seen from the curves A, B and C.

Figure 11:
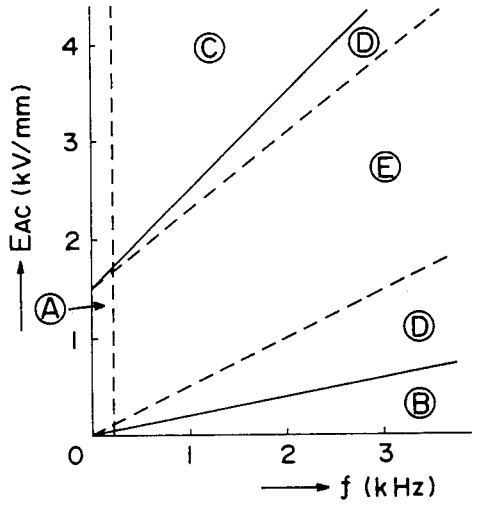
FIG. 11 is a graph showing the optimum condition of the developments using the two-component developer.

Here, experiments similar to those of FIGS. 9 and 10 were conducted under different conditions to reveal that the relationship between the amplitude $E_{AC}$ and the frequency f of the a.c. electric field intensity can be rearranged to provide the results shown in FIG. 11.

In FIG. 11: development irregularities are liable to occur in a zone indicated at Ⓐ; the effect of the a.c. component will not appear in a zone indicated at Ⓑ; the toner image formed in advance is liable to break in a zone indicated at Ⓒ; and the effect of the a.c. component appears to provide a sufficient development density, and the toner image formed in advance is not broken in zones indicated at Ⓓ and Ⓔ, of which the zone Ⓔ is especially preferable. results indicate that a proper zone is present with respect to the amplitude and frequency of the a.c. electric field intensity like the case of the one-component developer so as to prevent the toner image formed at a preceding step on the photosensitive drum 41 from being broken and to develop a subsequent (i.e., at a subsequent step) toner image in a proper density.

On the basis of the experimental results thus far described, I have concluded that the subsequent development can be conducted in the proper density without disturbing the toner image formed in advance on the photosensitive member 41, if each developing step satisfies the following condition:

$$0.2 \leqq V_{AC}/(d \cdot f); \text{ and}$$

$$[(V_{AC}/d) - 1500]/f \leqq 1.0,$$

wherein: the amplitude and frequency of the a.c. component of the developing bias is designated by $V_{AC}$ (V) and f (Hz), respectively; and the gap between the photosensitive drum 41 and the sleeve 7 is designated by d (mm). In order to obtain a sufficient image density and to leave undisturbed the toner image formed by the preceding step, it is more desirable to satisfy the following condition of the aforementioned one:

$$0.5 \leqq V_{AC}/(d \cdot f); \text{ and}$$

$$[(V_{AC}/d) - 1500]/f \leqq 1.0.$$

If the following condition of the above-specified ones is satisfied, it is possible to form a clearer multicolor image without any color mixing so that toners of different colors can be prevented from stealing into the developing device even after several operations;

$$0.5 \leqq V_{AC}/(d \cdot f); \text{ and}$$

$$[(V_{AC}/d) - 1500]/f \leqq 0.8.$$

It is more desirable to set the frequency of the a.c. component at 200 Hz or more as in the case of the one-component developer so as to prevent the development irregularities due to the a.c. component, and to set the frequency of the a.c. component at 500 Hz or more so as to eliminate the influences from the beats caused by the a.c. component and the rotations of the magnetic roll, in case a rotating magnetic roll is used as means for supplying the developer to the photosensitive drum 41.

Although the image forming process has been exemplified hereinbefore, in order to develop subsequent toner images sequentially in a constant density on the photosensitive drum 41 without breaking the toner image formed previously on the photosensitive drum 41, it is more preferable to adopt the following methods solely or in an arbitrary combination as the developments are repeated:

(1) Toners of higher charges are sequentially used;
(2) The amplitude of the a.c. component of the developing bias is sequentially reduced; and
(3) The frequency of the a.c. component of the developing bias is sequentially increased.

More specifically, the toner particles having the higher charges are more liable to be influenced by the electric field. As a result, if toner particles having high charges stick to the photosensitive drum 41 at the initial development, they may return to the sleeve at the development of a later step. By using toner particles of low charges for the initial development, therefore, the aforementioned method (1) contemplates to prevent those toner particles from returning to the sleeve at the development of a later step. By reducing the electric field intensity sequentially as the developments are repeated (i.e., at a later developing step), the method (2) contemplates to prevent the toner particles having sticked to the photosensitive drum 41 from returning. A specific method of reducing the electric field intensity is exemplified by a method of sequentially dropping the voltage of the a.c. component and by a method of making the gap d between the photosensitive drum 41 and the sleeve 7 wider for the later development. By increasing the frequency of the a.c. component sequentially as the developments are repeated, on the other hand, the aforementioned method (3) contemplates to prevent the toner particles having sticked to the photosensitive drum from returning. These methods (1), (2) and (3) are effective even if they are used solely but are more effective if they are combined such that the toner charges are sequentially increased whereas the a.c. bias is sequentially reduced as the developments are repeated. In case the above-specified three methods are adopted, moreover, a proper image density or color balance can be held by adjusting the d.c. bias for the respective methods.

Next, the relationship between the filters mounted on the front surface of the photosensitive member shown in FIGS. 1 and 2 and the light source for conducting the whole-surface exposure from that front surface will be described in the following. As has been described hereinbefore, the whole-surface exposing light generally has a wavelength distribution. On the other hand, each of the filters has a little transmissivity to a wavelength range other than its prescribed one. This means that the whole-surface exposing light considerably releases even the charges of other filter portions to form potential patterns in the other filter portions. As a result, the image forming apparatus according to the present method is accompanied by a problem that the whole-surface exposure cannot be applied without any restriction. I set the condition that the quantity of the whole-surface exposing light establishes a sufficient potential contrast for a prescribed filter but no potential contrast for the other filters. Moreover, this condition is also important for the case of the photosensitive member in which the filters have their portions overlapped with one another.

If the size of the filters is made the smaller, the resolution of the image to be reproduced is the better improved. For this improvement, however, it is necessary to position the B, G and R filters remarkably accurately when the filters are to be produced. Despite of this necessity, it is unavoidable in fact to make an overlap and mis-positioning of several microns.

The photoconductive layer underlying those overlapped portions will not release the charges thereform upon its image exposure because it has a lower transmissivity than that of the filter portions. In other words, the photoconductive layer acts as the black ground of an original document, which will form a potential pattern, if it is sufficiently subjected to the whole-surface exposure, so that the toner will stick to even the portion corresponding to the white ground of the document. In this case, too, restrictions on the quantity of the whole-surface exposing light would effectively prevent the generation of the potential pattern.

The portions, to which the filters have failed to stick due to the misregistration, will sufficiently release the charges of the photosensitive layer upon the image exposure because of the high transmissivity so that the potential contrast resulting from the whole-surface exposure is small. As a result, the toner will not stick to the highlighted portion to raise no problem.

Figure 12:
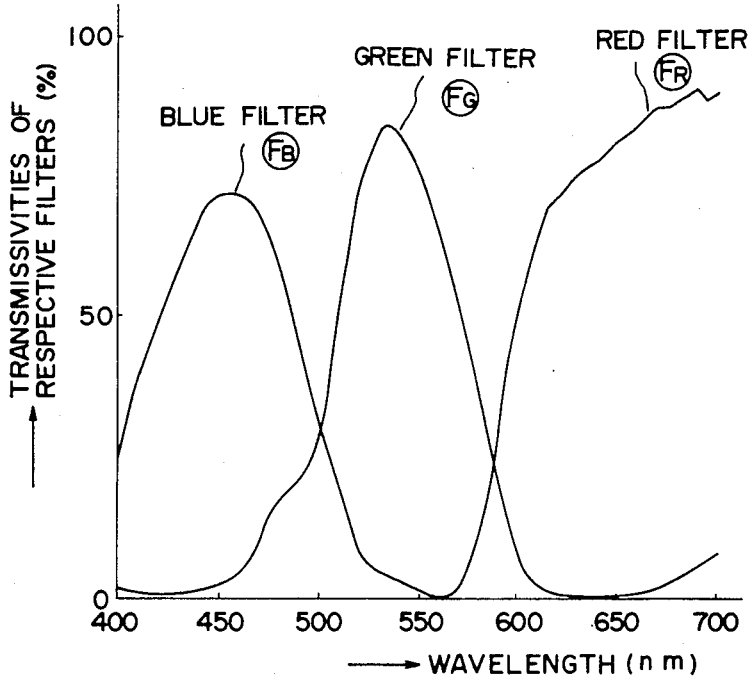
FIG. 12 is a graph showing the transmissivities of individual filters.
Figure 13:
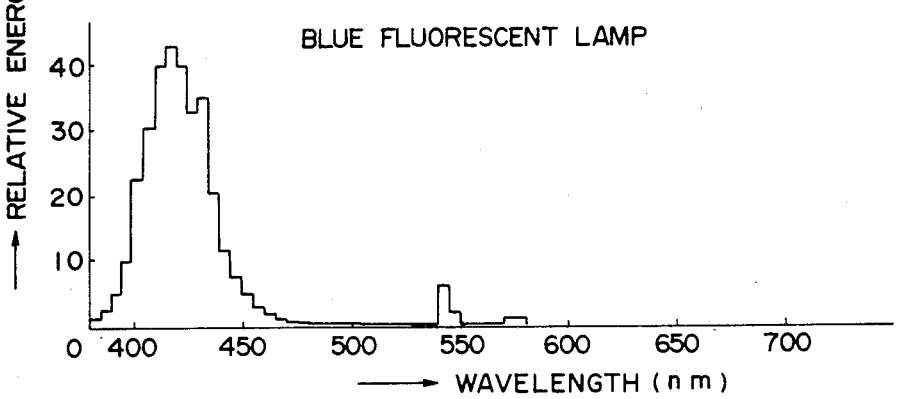
FIGS. 13(A), 13(B) and 13(C) are graphs showing the wavelength characteristics of blue, green and red fluorescent lamps, respectively.
Figure 13:
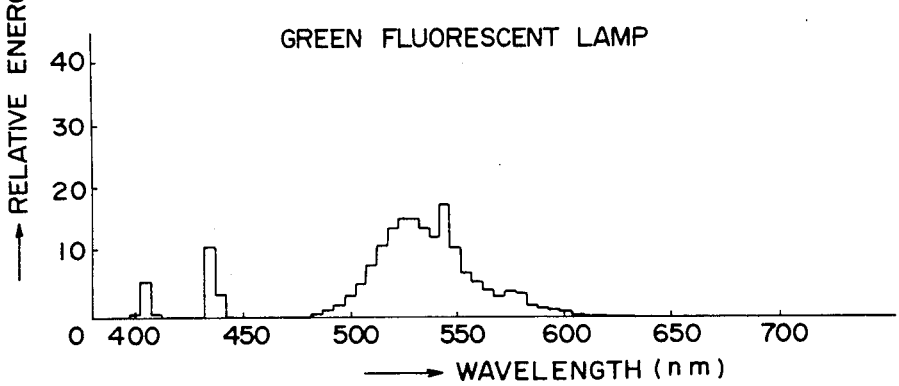
Figure 13:
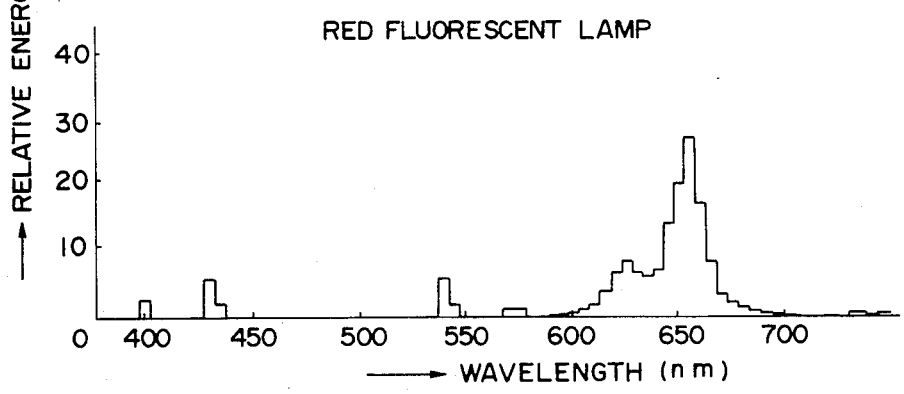

FIG. 12 shows one example of the transmissivities of the respective red (R), green (G) and blue (B) filters, which are positioned on the photosensitive member, against the optical wavelength. The transmissivities of all the filters plotted have skirted shapes. On the other hand, FIG. 13 shows an example of the relative outputs of whole-surface exposing fluorescent lamps against the optical wavelength. FIGS. 13(A), 13(B) and 13(O) show the characteristics of blue, green and red fluorescent lamps, respectively. It is found that the fluorescent lamp of each color has a more or less some wavelength distribution concerning other colors.

Figure 14:
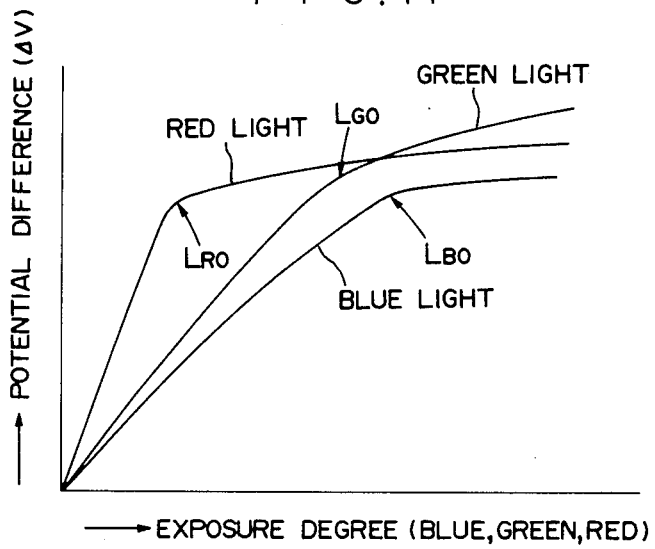
FIG. 14 is a graph showing the relationships between the degrees of the whole-surface exposures of the individual colors and the potential difference of the photosensitive member.

In FIG. 14, there are plotted against the degree of exposure potential differences which are generated by conducting the whole-surface exposures using the fluorescent lamps shown in FIG. 13 from the front surfaces of the filters. The plotted curves of the red (R), green (G) and blue (B) light are inflected at points $L_{R0}$, $L_{G0}$ and $L_{B0}$, as shown. The reason why the potentials are not saturated easily for the degree of the whole-surface exposure is thought to come from the decay of the trapped charges of other filter portions of the photosensitive layer and from the passage of the whole-surface exposing light through the other filter portions. It is found that especially the green light is reluctant to be saturated by the whole-surface exposure. This is because the blue (B) and red (R) colors have the skirted spectral transmissivity distributions, as shown in FIG. 12, and the green fluorescent lamp has the partially overlapped optical wavelength distribution, as shown in FIG. 13(B), so that the light comes partially into the photosensitive member underlying the blue (B) and red (R) filters to release the charges. This makes it necessary to set the degree of the whole-exposure of the green light at a proper level. For this necessity, it is preferable to conduct the whole-surface exposure of the green (G) light finally after the whole-surface exposures of the blue (B) and red (R) lights. Although the tendencies thus far described are found, each of the points of inflection $L_{R0}$, $L_{G0}$ and $L_{B0}$ appearing in FIG. 14 is defined as the light quantity $L_0$, at which the potential generated by the whole-surface exposure of the corresponding light exhibits its substantial saturation. If the whole-surface exposure degree $L_R$ of the red (R) light is designated at $L_{R0}$, if the whole-surface exposure degree $L_G$ of the green (G) light is designated at $L_{G0}$, and if the whole-surface exposure degree $L_B$ of the blue (B) light is designated at $L_{B0}$, the surface potentials on the photosensitive member of the embodiment by the respective specified lights were black ground potentials $V_R=250$ V, $V_G=270$ V, and $V_B=250$ V, respectively, for a white ground potential at about 0 V.

The color expressions were evaluated for the image in which the whole-surface exposure degrees were changed for the three kinds of color light of red (R), green (G) and blue (B) with respect to the light quantities $L_{R0}$, $L_{G0}$ and $L_{B0}$ at which the potentials generated by those whole-surface exposures exhibited substantial saturations.

The Yellow, Magenta and Cyan toners were applied to the filter portions, respectively.

TABLE 2

| | $L_R = L_{R0}$, $L_G = L_{G0}$, and $L_B = n_1L_{B0}$ | | | | | |
|---|---|---|---|---|---|---|
| $n_1$ | 0.6 | 0.8 | 1.0 | 2.0 | 4.0 | 6.0 |
| Image | X | ○ | ⊙ | ⊙ | ○ | X |

In the case of $L_B=0.6L_{B0}$ in the above test (i.e., Table-2), it was found that the Yellow image was short of density. In the case of $L_B=6L_{B0}$, on the contrary, it was found that the Yellow toner also sticked to the other filter portions to cause the color mixing and deteriorate the image quality. In the case of $L_B=0.9$ to $3.0L_{B0}$, it was found that the respective colors were satisfactorily reproduced.

TABLE 3

| | $L_R = L_{R0}$, $L_G = n_2L_{G0}$, and $L_B = L_{B0}$ | | | | | |
|---|---|---|---|---|---|---|
| $n_2$ | 0.6 | 0.8 | 1.0 | 2.0 | 4.0 | 6.0 |
| Image | X | ○ | ⊙ | ⊙ | ○ | X |

In the case of $L_G=0.6L_{G0}$ in the above test (i.e., Table-3), it was found that the Magenta image was short of density. In the case of $L_G=6L_{G0}$, on the contrary, it was found that the Magenta toner also sticked to the other filter portions to cause the color mixing and deteriorate the image quality. In the case of $L_G=0.9$ to $3.0L_{G0}$, it was found that the respective colors were satisfactorily reproduced.

TABLE 4

| | $L_R = n_3L_{R0}$, $L_G = L_{G0}$, and $L_B = L_{B0}$ | | | | | |
|---|---|---|---|---|---|---|
| $n_3$ | 0.6 | 0.8 | 1.0 | 2.0 | 4.0 | 6.0 |
| Image | X | ○ | ⊙ | ⊙ | ○ | X |

In the case of $L_R=0.6L_{R0}$ in the above test (i.e., Table-4), it was found that the Cyan image was short of density. In the case of $L_R=6L_{R0}$, on the contrary, it was found that the Cyan toner also sticked to the other filter portions to cause the color mixing and deteriorate the image quality. In the case of $L_R=0.9$ to $3.0L_{R0}$, it was found that the respective colors were satisfactorily reproduced.

The above-presented tests are the results which were obtained when the saturated quantities of the whole-surface exposures of the two kinds of color lights were $L_0$ whereas the whole-surface exposure degree of one color light was changed. It is found that substantially the same tendencies and results as the aforementioned ones were obtained in case, for $L_R=n_3L_{R0}$, $L_G=n_2L_{G0}$, and $L_B=n_1L_{B0}$, the values $n_1$, $n_2$ and $n_3$ were changed to change the whole-surface exposure degrees, respectively.

Next, the following description is directed to the specific examples of the experiments which were conducted on the basis of the conclusions made above.

In case a multicolor image was recorded under the following conditions of Table-5, more specifically, it was possible to make records of excellent color expressions by adding and mixing the colors without any superposition of the toners of the respective colors.

TABLE 5

| | |
|---|---|
| Photosensitive Member: (FIG. 2(B)) | Photoconductive Layer: CdS (40 μm); Filter: mosaic shape (FIG. 1(B)) (20 μm), l = 150 μm; Drum Diameter = 180 mm; |

TABLE 5-continued

| | |
|---|---|
| | Linear Velocity = 100 mm/sec; |
| Developing Device: (FIG. 5) | Sleeve: of Non-Magnetic Stainless Steel; Diameter = 30 mm; Rotational Velocity or Linear Velocity = = 100 mm/sec; Magnet Roll: Number of Magnetic Poles: 8; Density of Magnetic Flux: Max. 800 G (on Sleeve Surface); Rotational Velocity: 600 r.p.m.; |
| Gap between Sleeve and Photosensitive Member: | 0.75 mm |
| Developer: | Toners (Yellow, Magenta and Cyan): Average Diameter: 10 μm; Negative Charge: −10 to −20 μc/g; Carrier: Dispersion of Magnetic Material in Resin: Average Diameter: 25 μm; Resistivity: $10^{13}$ Ω-cm or more; Weight Mixing Ratio: Toner:Carrier = 1:9; |
| Developer Layer: | Thickness = 0.5 mm; |
| Initially Charged Photosensitive Member: | Surface Potential = 2.5 kV (by Corotron); |
| Simultaneously Image Exposed and Charged Photosensitive Member: | Surface Potential = +50 V (by Scorotron); |
| Uniformalized Photo-Sensitive Member: | Surface Potential = 0 V (by Scorotron); |
| Specified Lights: | Uniform Exposure Degrees = $L_{B0}$; $L_{G0}$; $L_{R0}$; |
| Surface Potentials by Uniform Exposures of Specified Light: | +250 V (Blue); +270 V (Green); +250 V (Red); |
| Developing Bias: (Common) | DC: +50 V; AC: +1.5 kV(Effective value); 2 kHz |

The multicolor image forming method according to the present invention should naturally contain not only the image forming method according to the developing method thus far described but also, as its modifications, the method (as is disclosed in Japanese Patent Laid-Open No. 59-42565 and Japanese patent application No. 58-231434), in which only toner is extracted from a composite developer onto a developer carrier to effect a one-component development in an alternating electric field, the method (as is disclosed in Japanese Patent Laid-Open No. 56-125753), in which a linear or net-shaped control electrode is provided to effect a development with a one-component developer in an alternating electric field, and an apparatus (as is disclosed in Japanese patent application No. 58-97973), in which a similar control electrode is provided to effect a development with a two-component developer in an alternating electric field.

The method of transferring the toner image uses the corona transfer in the embodiments thus far described but can use another method. If the adhesion transfer disclosed in Japanese patent publication Nos. 46-41679 and 48-22763, for example, the transfer can be conducted without any consideration of the toner polarity. It is also possible to adopt the method of directly fixing a photosensitive member, as in the electrofax.

Moreover, the layer structure of the photosensitive member can be composed of a transparent insulating layer, a photoconductive layer, a transparent conductive layer and a filter, as is disclosed in Japanese patent application No. 59-19954, to conduct the development from the side of the transparent insulating layer by effecting each charging operation from the side of the transparent insulating layer, the image exposure and the whole-surface exposure from the side of the filter at the back.

The present invention is also preferably applied to the color and transparent filter portions disclosed in Japanese patent application No. 59-198167, in which the filters are partially transparent, and the quantities of the whole-surface exposing light are similar.

Furthermore, the present invention can also be applied to an image forming method which repeats a primary charge, a secondary charge of substantially opposite polarity to that of the primary charge, a whole-surface exposure with recharged specified light for smoothing a potential pattern after the image exposure, and a development with specified color toner.

Furthermore, the present invention can also be applied to both an image forming method, as is disclosed in Japanese patent application No. 59-201085, in which, after a photosensitive member constructed of an insulating layer and a photosensitive layer having a color separating function has been subjected to a primary charge and simultaneously to a secondary charge and an image exposure, a development with color toner of specified color for a whole-surface exposure and a recharge for smoothing a potential pattern are repeated, and an image forming method in which, after a primary charge, a secondary charge of substantially opposite polarity to that of the primary charge and an image exposure, a recharge for smoothing a potential pattern and development with toner of specified color are repeated. Since, in this case, the spectral sensitivity distribution of the photosensitive layer also has sensitivity to other wavelength ranges like a color separating filter, the potential pattern is formed in other portions by the whole-surface exposure by the specified light thereby to mix the colors and deteriorate the resolution. A satisfactory color reproduction can be obtained by making proper the whole-surface exposure with the specified light.

On the other hand, the description thus far made is wholly directed to the examples of a color copying machine using the so-called "trichromatic filter" and "toners of three primaries". However, the modes of embodiment of the present invention should not be limited thereto but can find their wide applications to a variety of multicolor image recording apparatus and color photoprinters. The colors of chromatic filters and their combinations with the colors of corresponding toners can naturally be arbitrarily selected for the purposes intended.

At the multicolor image forming steps described hereinbefore, the whole-surface exposing light need not always be limited to the B, G and R light. In that filter portion of the photosensitive member, which has been subjected to the whole-surface exposure, more specifically, the charges on the boundary surface between the insulating layer and the photoconductive layer have already disappeared so that the surface potential will hardly change even with next transmission of a light. As a result, it is possible to form a multicolor image having succeeded in reproducing the colors of an original document to a satisfactory extent, even if the whole-surface exposures are conducted in the order of red, yellow and white light, for example, accordingly followed by developments with Cyan, Magenta and Yellow toners in this order. Of course, the present invention should not be limited to the above colors but may conduct the whole-surface exposures with light having other spectral distributions. Incidentally, if the whole-surface exposing light is transmitted twice or more times through some of the filters lying on the photosensitive member, as described above, it is desirable to make an optical irradiation after the developments so as completely eliminate the charges on the boundary surface between the insulating layer and the photoconductive layer. Furthermore, the filter structure of the photosensitive member should not be limited to the aforementioned one but can have its pattern or arrangement modified in various manners.

As has been described hereinbefore, according to the present invention, the toners to stick to the multicolor image forming photosensitive member can be prevented completely or sufficiently from overlapping with one another so that colors can be completely added and mixed to form a multicolor image having a satisfactory color reproduction.

By using that photosensitive member, moreover, after the primary latent image formation by the image exposure, the whole-surface exposure step for forming a potential pattern at least one kind of color separating function portions and the development step are repeated so that each of the steps of the whole-surface charge and the image exposure required can be only one although several steps have been required according to the prior art. This makes it unnecessary to register the various images before they are transferred so that the apparatus can be small-sized, speeded up and made highly reliable. The records obtained have neither any color drift nor color mixing so that the resultant images can have their colors reproduced to a satisfactory extent and can have a high quality.

What is claimed is:

1. An image forming method comprising the steps of:

providing a photoreceptor having a photoconductive layer on a conductive member and an insulating layer including a filter layer having groups of fine filters distrubuted therein, each of said groups being capable of passing a specific color to said insulating layer on said photoconductive layer, charging said photoreceptor with a charging means whereby a first substantially uniform charge is placed thereon, imagewise exposing the surface of said photoreceptor in the presence of an alternating current or a charge opposite to said uniform charge, exposing said surface with light corresponding to said specific color, a quantity of said light L is expressed by a following formula for a light quantity Lo indicating that a potential generated substantially saturated:

$$0.7Lo \leqq L \leqq 5Lo$$

whereby a potential pattern is formed on portions of said photoreceptor corresponding to said specific color, developer said potential pattern by a toner of appropriate color, and repeating said exposing and developing.

2. The method of claim 1 further comprising the step of:

subjecting said surface to a second substantially uniform charge opposite to said first uniform charge, before said exposing in said repeating whereby deposition of said toner on unwanted areas is minimized.

3. The method of claim 2 wherein said quantity of said light L is expressed prefereably by a following formula:

$$0.9Lo \leqq L \leqq 3Lo.$$

4. The method of claim 2 wherein said repeating takes place at least twice.

5. The method of claim 2 wherein there are distributed mutually different spectral transmission characteristics of a layer of plural kinds of fine filters contained in said insulating layer, and wherein at least two kinds of said filters are capable of substantially transmitting a light in any hue.

6. The method of claim 2 wherein at least part of the charge remaining on said photoconductive layer is eliminated.

7. The method of claim 2 wherein in said repeating said developing is carried out so that a developer layer on a developing device makes no substantial contact with said surface.

8. The method of claim 4 wherein said surface has a substantially uniform surface potential thereon before each said uniformly exposing after said developing said potential pattern by a toner of appropriate color.

9. The method of claim 5 wherein a layer provided on said photoreceptor comprises plural kinds of filters, among said fine filters, which are capable of transmitting mainly the rays of light of an identical hue and are mutually different in a maximum percent transmission and/or maximum transmission wavelength of light.

10. The method of claim 6 wherein said charge remaining is in areas corresponding to those to which toners adhere.

11. An image forming method comprising the steps of:

providing a photoreceptor having an insulating layer containing a first plurality of first filters capable of transmitting the short wavelengths of visible light, a second plurality of second filters capable of transmitting the medium wavelength of visible light, and a third plurality of third filters capable of transmitting the long wavelength of visible light, a photoconductive layer having a spectral sensitivity covering substantially the entire wavelength region of visible light, and a conductive base member, charging said photoreceptor with a charging means whereby a first substantially uniform charge is placed thereon, imagewise exposing the surface of said photoreceptor in the presence of an alternating current or a charge opposite to said first uniform charge, forming a primary electrostatic image by exposure of said surface to a pirmary light which contains a component capable of passing through one said plurality of said filters and containing substantially no component capable of passing through the other pluralities of said filters, a quantity of said primary light L is expressed by a following formula for a light quantity Lo indicating that a potential generated is substantially saturated:

$0.7Lo \leqq L \leqq 5Lo$ whereby a potential pattern is formed on portions of said photoreceptor corresponding to said specific color, developing said primary image by a first color toner, at least partly evening the potentials remaining on said surface by charging with a second uniform charge opposite to said first uniform charge, after developing said primary image, forming a secondary electrostatic image by exposure of said surfce to a secondary light which contains a component capable of passing through another said plurality of said filters and containing substantially no component capable of passing through the remaining plurality of said filters, a quantity of said secondary light L' is expressed by a following formula for a light quantity L'o indicating that a potential generated is substantially saturated:

$0.7L'o \leqq L' \leqq 5L'o$ whereby a potential pattern is formed on portions of said photoreceptor corresponding to said specific color, and developing said secondary image by a second color toner.

12. The method of claim 11 further comprising the steps of:

at least partly evening the potentials remaining on said surface, by charging with a tertiary uniform charge opposite to said first uniform charge, after developing said secondary image, forming a tertiary electrostatic image by exposure of said surface ot a tertiary light which contains a component capable of passing through at least said remaining plurality of said filters, and developing said tertiary image by a third color toner.

13. The method of claim 11 wherein said quantity of said pirmary light L is expressed preferably by a following formula:

$0.9Lo \leqq L \leqq 3Lo.$

14. The method of claim 11 wherein said quantity of said secondary light L' is expressed preferably by a following formula:

$0.9L'o \leqq L' \leqq 3L'o.$

15. The method of claim 12 wherein said primary light is a blue light, said secondary light is a green light and said tertiary light is a red light.

16. The method of claim 12 wherein said tertiary light is a green light.

* * * * *